US010850515B2

(12) United States Patent
Aimono et al.

(10) Patent No.: US 10,850,515 B2
(45) Date of Patent: Dec. 1, 2020

(54) LIQUID EJECTING HEAD AND LIQUID EJECTING APPARATUS

(71) Applicant: SEIKO EPSON CORPORATION, Tokyo (JP)

(72) Inventors: Takanori Aimono, Matsumoto (JP); Masao Nakayama, Shiojiri (JP); Motoki Takabe, Shiojiri (JP); Hitoshi Takaai, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/574,683

(22) Filed: Sep. 18, 2019

(65) Prior Publication Data

US 2020/0094553 A1 Mar. 26, 2020

(30) Foreign Application Priority Data

Sep. 20, 2018 (JP) ..... 2018-176499
Mar. 18, 2019 (JP) ..... 2019-050118

(51) Int. Cl.
*B41J 2/14* (2006.01)

(52) U.S. Cl.
CPC .. *B41J 2/14233* (2013.01); *B41J 2002/14241* (2013.01)

(58) Field of Classification Search
CPC ..... B41J 2/14233; B41J 2/14201; B41J 2/14274; B41J 2/17526; B41J 2/17556
See application file for complete search history.

(56) References Cited

U.S. PATENT DOCUMENTS

2009/0207213 A1* 8/2009 Tsuda ..... 347/70
2016/0035963 A1 2/2016 Kurokawa
2017/0217180 A1 8/2017 Nakayama et al.

FOREIGN PATENT DOCUMENTS

JP 2016-033937 3/2016
JP 2017-139331 8/2017

* cited by examiner

*Primary Examiner* — Juanita D Jackson
(74) *Attorney, Agent, or Firm* — Workman Nydegger

(57) ABSTRACT

A liquid ejecting head including a plurality of pressure chambers in communication with nozzles that eject a liquid, a diaphragm that includes layers including a first layer and a second layer and that constitutes wall surfaces of the plurality of pressure chambers, a plurality of piezoelectric elements formed on a first region of the diaphragm, the piezoelectric elements each being formed to correspond to a corresponding one of the pressure chambers, and a barrier layer that is in contact with an interface between the first layer and the second layer in a second region of the diaphragm, the second region surrounding the first region.

15 Claims, 10 Drawing Sheets

LIQUID EJECTING HEAD AND LIQUID EJECTING APPARATUS

The present application is based on, and claims priority from JP Application Serial Number 2018-176499, filed Sep. 20, 2018, and JP Application Serial Number 2019-050118, filed Mar. 18, 2019, the disclosures of which are hereby incorporated by reference herein in their entirety.

BACKGROUND

1. Technical Field

The present disclosure relates to a liquid ejecting head and a liquid ejecting apparatus.

2. Related Art

Hitherto, a technique has been proposed in which a liquid such as ink or the like filled in a pressure chamber is ejected from a nozzle by vibrating a diaphragm, which constitutes a wall surface of the pressure chamber, with a piezoelectric element. For example, JP-A-2017-139331 discloses a configuration in which a diaphragm is formed by layers including an elastic film formed of silicon oxide and an insulating film formed of zirconium oxide. Furthermore, JP-A-2016-033937 discloses a configuration in which a moisture-resistant layer that blocks moisture, which has permeated a protective film, from proceeding is interposed between the protective film formed of silicon oxide and a rigid film formed of zirconium oxide.

An object of the configuration of JP-A-2016-033937 is to block the moisture, which is from a side opposite the rigid film when viewed from the protective film, from proceeding; accordingly, it is essential that the moisture-resistant layer is formed across the entire surface of the diaphragm. However, in a configuration in which the moisture-resistant layer is formed across the entire surface of the diaphragm, since the vibration of the diaphragm is suppressed by the moisture-resistant layer, displacement of the diaphragm may not be obtained sufficiently.

SUMMARY

In order to overcome the above issue, a liquid ejecting head according to a suitable aspect of the present disclosure includes a plurality of pressure chambers in communication with nozzles that eject a liquid, a diaphragm that includes layers including a first layer and a second layer and that constitutes wall surfaces of the plurality of pressure chambers, a plurality of piezoelectric elements formed on a first region of the diaphragm in plan view of the diaphragm, the piezoelectric elements each being formed to correspond to a corresponding one of the pressure chambers, and a barrier layer that covers an interface between the first layer and the second layer in a second region of the diaphragm, the second region surrounding the first region.

DESCRIPTION OF EXEMPLARY EMBODIMENTS

First Embodiment

Figure 1:
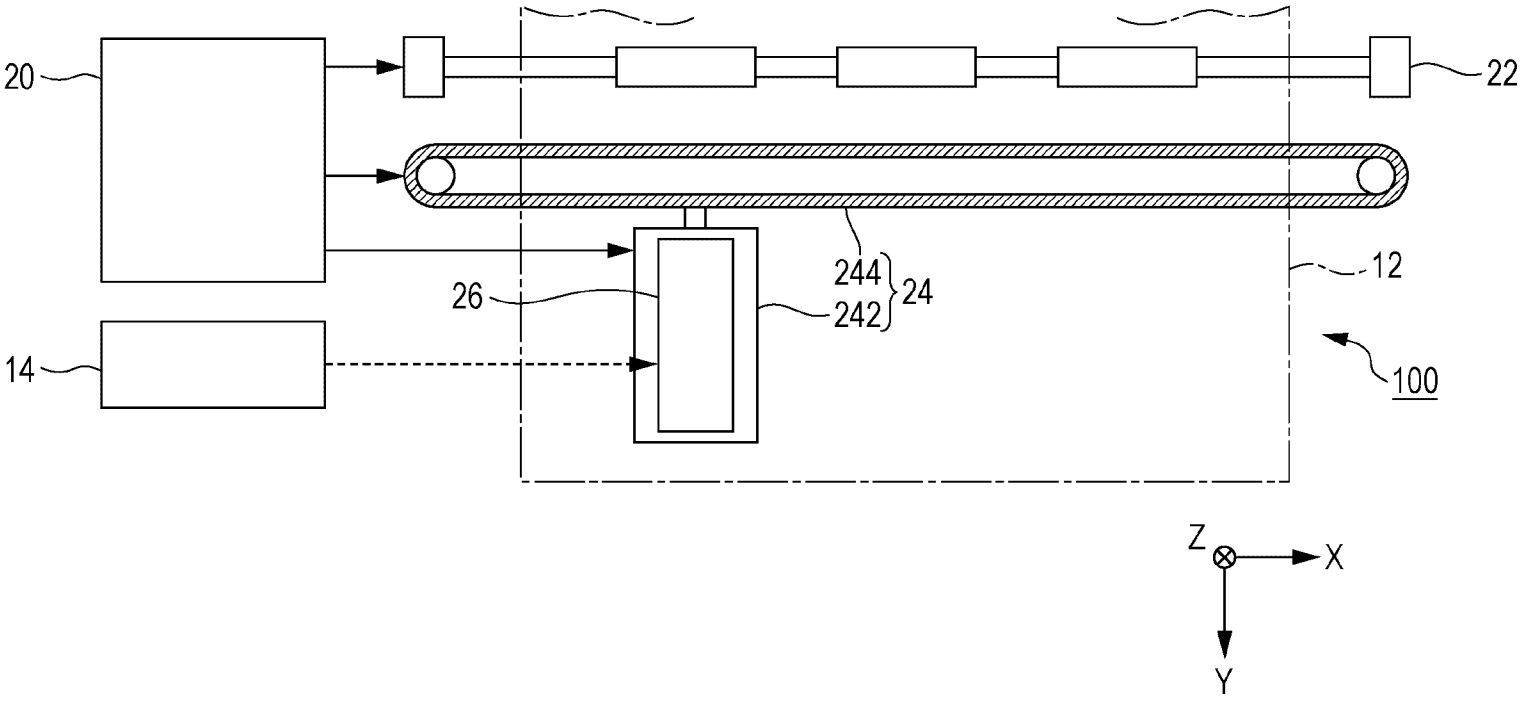
FIG. 1 is a block diagram illustrating as an example a configuration of a liquid ejecting apparatus according to a first embodiment.

FIG. 1 is a block diagram illustrating an example of a liquid ejecting apparatus 100 according to a first embodiment. The liquid ejecting apparatus 100 of the first embodiment is an ink jet printing apparatus that ejects ink, which is an example of a liquid, on a medium 12. While the medium 12 is typically printing paper, an object to be printed formed of any material, such as a resin film or fabric, is used as the medium 12. As illustrated as an example in FIG. 1, a liquid container 14 that stores ink is installed in the liquid ejecting apparatus 100. For example, a cartridge configured to detach from the liquid ejecting apparatus 100, a bag-shaped ink pack formed of flexible film, or an ink tank into which ink can be refilled is used as the liquid container 14. A plurality of types of inks of different colors or characteristics are stored in the liquid container 14.

As illustrated as an example in FIG. 1, the liquid ejecting apparatus 100 includes a control unit 20, a transport mechanism 22, a moving mechanism 24, and a liquid ejecting head 26. The control unit 20 includes, for example, a processing circuit such as a central processing unit (CPU) or a field programmable gate array (FPGA) and a memory circuit such as a semiconductor memory, and controls each element of the liquid ejecting apparatus 100 in an integrated manner. The transport mechanism 22 transports the medium 12 in a Y direction under the control of the control unit 20.

The moving mechanism 24 reciprocates the liquid ejecting head 26 in an X direction under the control of the control unit 20. The X direction is a direction orthogonal to the Y direction in which the medium 12 is transported. The moving mechanism 24 of the first embodiment includes a substantially box-shaped transport body 242 that houses the liquid ejecting head 26 and a transport belt 244 to which the transport body 242 is fixed. Note that a configuration in which a plurality of liquid ejecting heads 26 are mounted in the transport body 242 or a configuration in which the liquid container 14 is mounted in the transport body 242 together with the liquid ejecting head 26 can be adopted.

The liquid ejecting head 26 ejects ink, which is supplied from the liquid container 14, to the medium 12 through a plurality of nozzles under the control of the control unit 20. Concurrently with the transportation of the medium 12 performed with the transport mechanism 22 and the repetitive reciprocation of the transport body 242, the liquid ejecting head 26 ejects ink onto the medium 12 to form a desired image on a surface of the medium 12. Note that a direction perpendicular to an XY plane is hereinafter referred to as a Z direction. The direction in which the ink is ejected by the liquid ejecting head 26 corresponds to the Z direction. The XY plane is, for example, a plane parallel to the surface of the medium 12.

Figure 2:
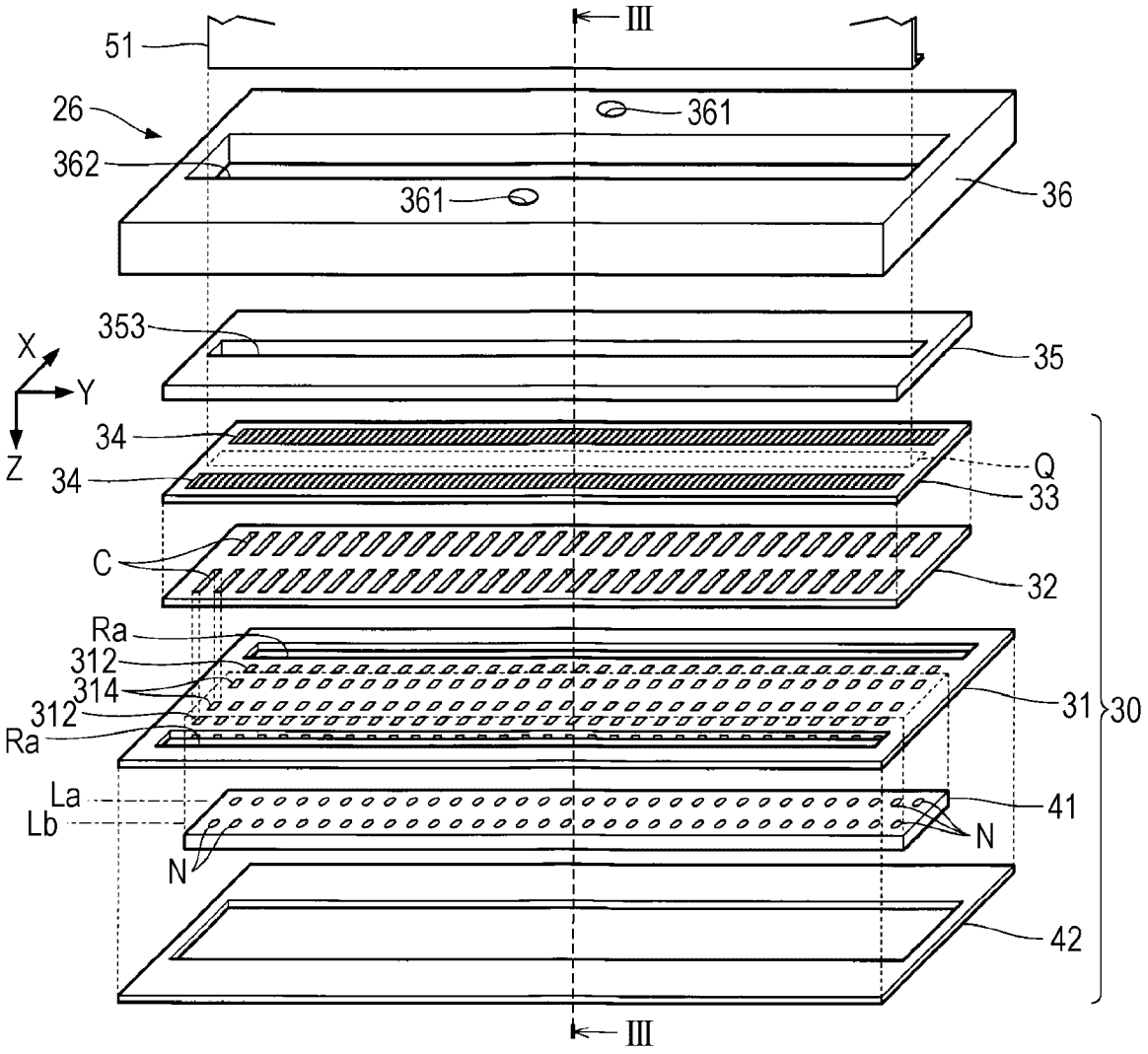
FIG. 2 is an exploded perspective view of a liquid ejecting head.
Figure 3:
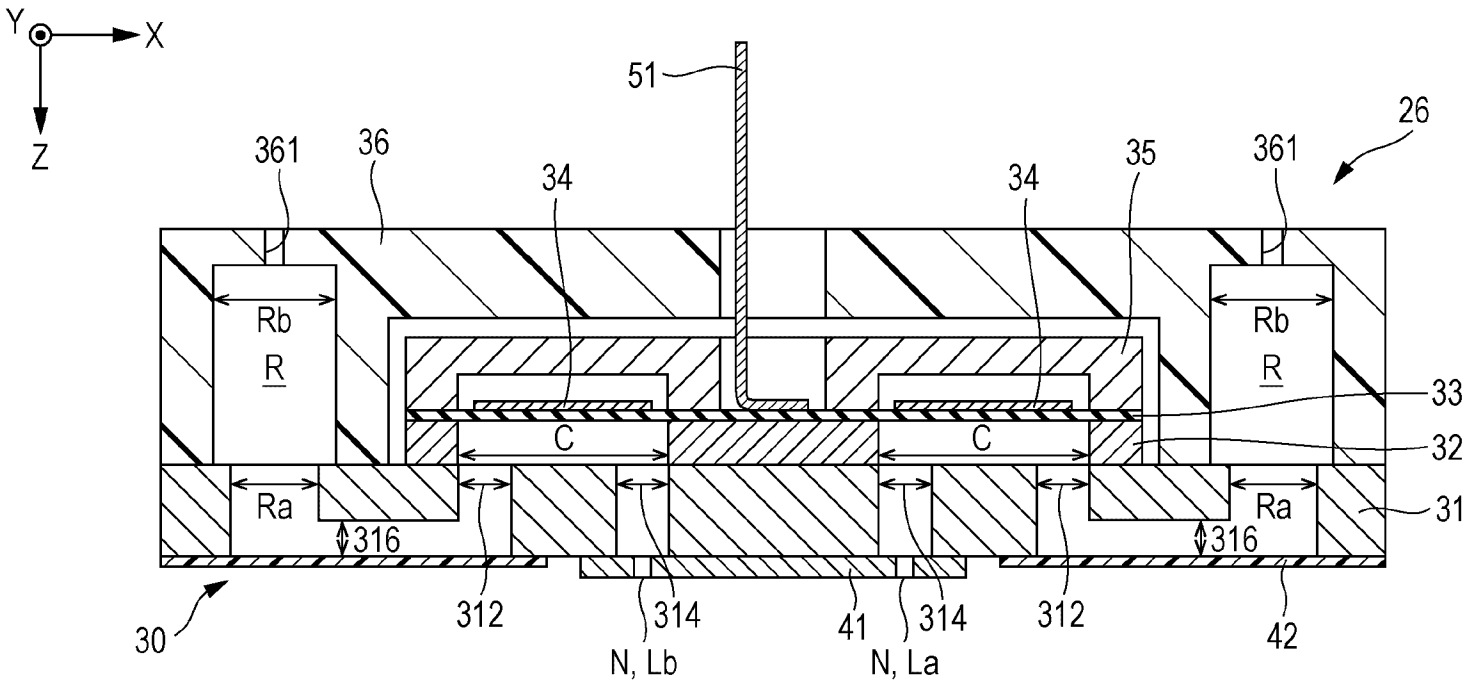
FIG. 3 is a cross-sectional view of the liquid ejecting head.

FIG. 2 is an exploded perspective view of the liquid ejecting head 26, and FIG. 3 is a cross-sectional view taken along line III-III in FIG. 2. As illustrated as an example in FIG. 2, the liquid ejecting head 26 includes a plurality of nozzles N arranged in the Y direction. The plurality of nozzles N of the first embodiment are divided into a first line La and a second line Lb that are parallelly arranged with a space in between in the X direction. The first line La and the second line Lb are each a set of plurality of nozzles N linearly arranged in the Y direction. As it can be understood from FIG. 3, the liquid ejecting head 26 of the first embodiment is structured so that the elements related to each of the nozzles N in the first line La and the elements related to each of the nozzles N in the second line Lb are disposed in a substantially plane symmetric manner. Accordingly, in the following description, the elements corresponding to the first line La will be described extensively and a description of the elements corresponding to the second line Lb will be omitted as appropriate.

As illustrated as an example in FIGS. 2 and 3, the liquid ejecting head 26 includes a flow path structure 30, a plurality of piezoelectric elements 34, a sealing member 35, a housing portion 36, and a wiring substrate 51. The flow path structure 30 is a structure in which flow paths that supply ink to each of the plurality of nozzles N are formed. The flow path structure 30 of the first embodiment includes a flow path substrate 31, a pressure chamber substrate 32, a diaphragm 33, a nozzle plate 41, and a vibration absorber 42. Each member constituting the flow path structure 30 is a plate-shaped member elongated in the Y direction. The pressure chamber substrate 32 and the housing portion 36 are provided on a surface of the flow path substrate 31 on the negative side in the Z direction. On the other hand, the nozzle plate 41 and the vibration absorber 42 are provided on a surface of the flow path substrate 31 on the positive side in the Z direction. Each member is fixed with an adhesive agent, for example.

The nozzle plate 41 is a plate-shaped member having the plurality of nozzles N formed therein. Each of the plurality of nozzles N is a circular through hole through which ink is ejected. The nozzle plate 41 is manufactured by processing a single crystal substrate formed of silicon (Si) using a semiconductor manufacturing technique such as, for example, photolithography and etching. However, any known materials and any known manufacturing methods can be adopted to manufacture the nozzle plate 41.

As illustrated as an example in FIGS. 2 and 3, spaces Ra, a plurality of supply flow paths 312, a plurality of communication flow paths 314, and relay liquid chambers 316 are formed in the flow path substrate 31. Each space Ra is an elongated opening formed in the Y direction in plan view viewed in the Z direction, and the supply flow paths 312 and the communication flow paths 314 are each through holes formed for a corresponding nozzle N. Each relay liquid chamber 316 is an elongated space formed in the Y direction across a plurality of nozzles N, and communicates the space Ra and the plurality of supply flow paths 312 to each other. Each of the plurality of communication flow paths 314 overlaps a corresponding single nozzle N in plan view.

As illustrated as an example in FIGS. 2 and 3, a plurality of pressure chambers C are formed in the pressure chamber substrate 32. Each pressure chamber C is formed for each nozzle N and is a space elongated in the X direction in plan view. The plurality of pressure chambers C are arranged in the Y direction. Similar to the nozzle plate 41 described above, for example, the flow path substrate 31 and the pressure chamber substrate 32 are manufactured by processing a single crystal substrate formed of silicon using a semiconductor manufacturing technique. However, any known materials and any known manufacturing methods can be adopted to manufacture the flow path substrate 31 and the pressure chamber substrate 32.

As illustrated as an example in FIG. 2, the diaphragm 33 configured to elastically deform is provided on a surface of the pressure chamber substrate 32 opposite the flow path substrate 31. The diaphragm 33 is a plate-shaped member formed in a rectangular shape elongated in the Y direction when viewed in plan view in the Z direction. As understood from FIG. 3, the pressure chambers C are spaces located between the flow path substrate 31 and the diaphragm 33. In other words, the diaphragm 33 constitutes a wall surface of each pressure chamber C. As illustrated in FIGS. 2 and 3, the pressure chambers C are in communication with the communication flow paths 314 and the supply flow paths 312. Accordingly, the pressure chambers C are in communication with the nozzles N through the communication flow paths 314 and are in communication with the spaces Ra through the supply flow paths 312 and the relay liquid chambers 316. Plan view in the Z direction can be rephrased as a view in a direction perpendicular to the diaphragm 33 or a plan view of the diaphragm 33.

Figure 4:
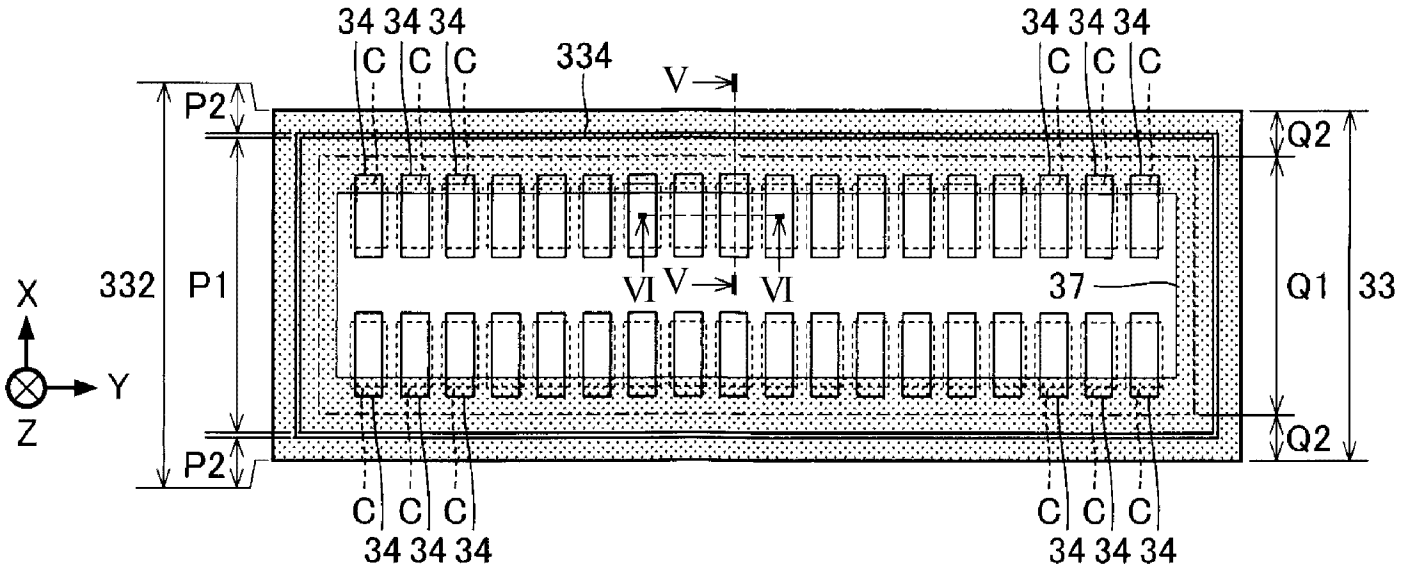
FIG. 4 is a plan view of a diaphragm.

FIG. 4 is a plan view of the diaphragm 33. FIG. 4 illustrates a surface of the diaphragm 33 on the negative side in the Z direction. As illustrated as an example in FIG. 4, the surface of the diaphragm 33 is divided into a first region Q1 and a second region Q2. The first region Q1 is a rectangular-shaped region. The second region Q2 is a rectangular frame-shaped region surrounding the first region Q1. In other words, the second region Q2 is a region between a periphery of the first region Q1 and a periphery of the diaphragm 33. As illustrated as an example in FIG. 4, the plurality of pressure chambers C are formed inside the first region Q1 in plan view in the Z direction. The first region Q1 may be understood as a region in the diaphragm 33 that overlaps the plurality of pressure chambers C in plan view.

As illustrated as an example in FIGS. 2 and 3, the piezoelectric elements 34, each for a corresponding pressure chamber C, are formed on a side of the diaphragm 33 opposite the pressure chambers C. In other words, the diaphragm 33 is located between the pressure chambers C and the piezoelectric elements 34. The piezoelectric element 34 is a passive element elongated in the X direction in plan view. Each piezoelectric element 34 changes the pressure in the corresponding pressure chamber C by being deformed according to a voltage applied thereto. By having the piezoelectric element 34 change the pressure inside the pressure chamber C, the ink inside the pressure chamber C is ejected from the nozzle N. As illustrated as an example in FIG. 4, the plurality of piezoelectric elements 34 are formed inside the first region Q1 of the diaphragm 33 in plan view in the Z direction. The first region Q1 may be understood as a region in the diaphragm 33 that overlaps the plurality of piezoelectric elements 34 in plan view. As understood from the above description, the plurality of piezoelectric elements 34 are formed on the first region Q1 of the diaphragm 33 so that each piezoelectric element 34 corresponds to the corresponding pressure chamber C.

The housing portion 36 in FIG. 3 is a case that stores the ink supplied to the plurality of pressure chambers C and is, for example, formed of a resin material by injection molding. Spaces Rb and supply holes 361 are formed in the housing portion 36. The supply holes 361 are pipelines through which the ink is supplied from the liquid container 14 and are in communication with the spaces Rb. The spaces Rb of the housing portion 36 and the spaces Ra of the flow path substrate 31 are in communication with each other. Spaces configured by the space Ra and the space Rb function as liquid storage chambers R that store the ink supplied to the plurality of pressure chambers C. The ink that has been supplied from the liquid container 14 and that has passed through the supply holes 361 is stored in the liquid storage chambers R. The ink that has been stored in the liquid storage chambers R is branched from the relay liquid chambers 316 to the supply flow paths 312 and is supplied and filled in parallel into the pressure chambers C. The vibration absorber 42 is a flexible film constituting wall surfaces of the liquid storage chambers R and absorbs the pressure fluctuations of the ink inside the liquid storage chambers R.

The sealing member 35 is a structure that protects the plurality of piezoelectric elements 34 and that reinforces the mechanical strength of the pressure chamber substrate 32 and the mechanical strength of the diaphragm 33. The sealing member 35 is fixed to the surface of the diaphragm 33 with an adhesive agent, for example. The plurality of piezoelectric elements 34 is accommodated inside recessed portions formed in a surface of the sealing member 35 opposing the diaphragm 33. Furthermore, the wiring substrate 51 is joined to the surface of the diaphragm 33. The wiring substrate 51 is a mounted component on which a plurality of wires (not shown) are formed to electrically couple the control unit 20 and the liquid ejecting head 26 to each other. The flexible wiring substrate 51 such as, for example, a flexible printed circuit (FPC) or a flexible flat cable (FFC) is desirably used. A drive signal and a reference voltage that drive the piezoelectric elements 34 are supplied to each of the piezoelectric elements 34 from the wiring substrate 51.

Figure 5:
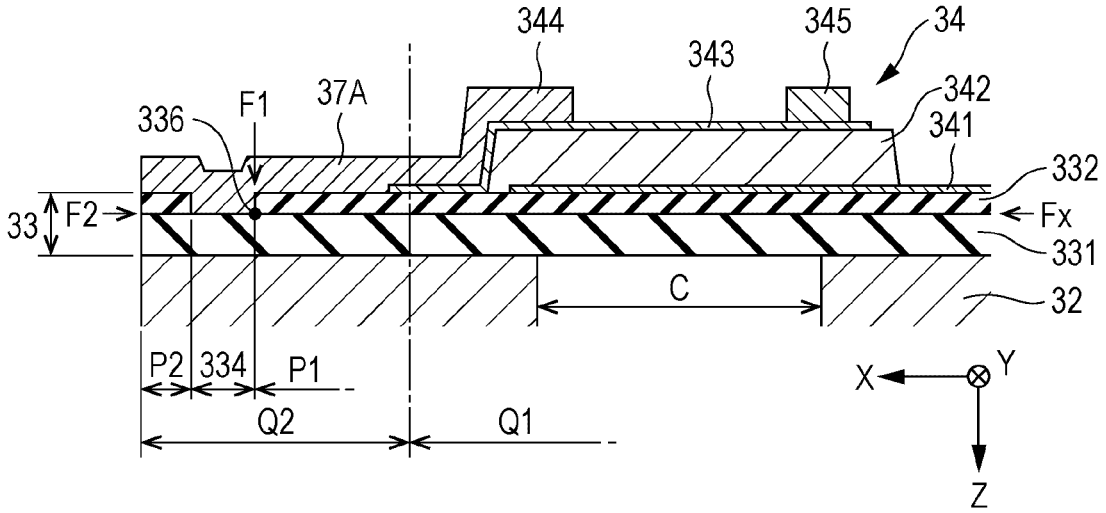
FIG. 5 is a cross-sectional view taken along line V-V in FIG. 4.
Figure 6:
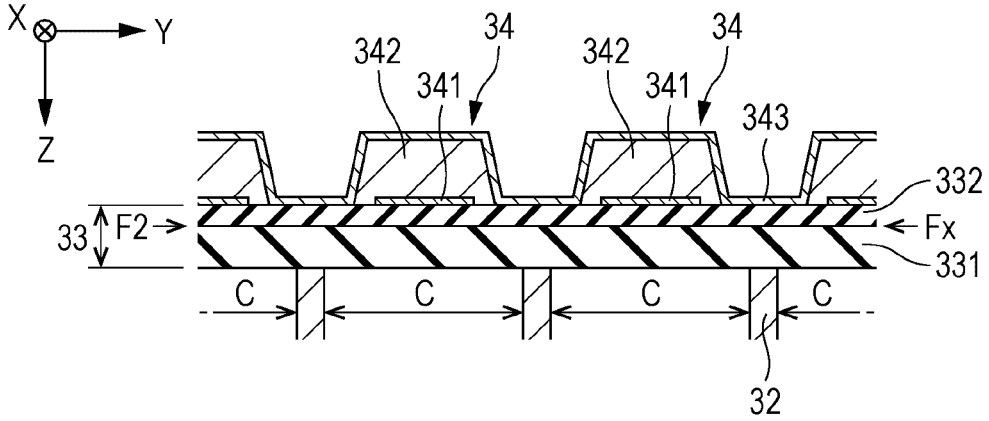
FIG. 6 is a cross-sectional view taken along line VI-VI in FIG. 4.

FIG. 5 is a cross-sectional view taken along line V-V in FIG. 4, and FIG. 6 is a cross-sectional view taken along line VI-VI in FIG. 4. As illustrated as an example in FIGS. 5 and 6, the piezoelectric elements 34 are configured of layers including first electrodes 341, piezoelectric layers 342, second electrodes 343, first conductive layers 344, and second conductive layers 345.

The first electrodes 341 are each an individual electrode formed on the surface of the diaphragm 33 for the corresponding piezoelectric element 34 and are distanced away from each other. A drive signal formed for each piezoelectric element 34 is supplied to each first electrode 341. Each piezoelectric layer 342 is a ferroelectric piezoelectric material such as, for example, lead zirconate titanate formed on a surface of the corresponding first electrode 341. Each second electrode 343 is formed on a surface of the corresponding piezoelectric layer 342. As understood from FIG. 6, each second electrode 343 of the first embodiment is a strip-like common electrode that is continuous across the plurality of piezoelectric elements 34. A predetermined reference voltage is applied to each second electrode 343. As understood from FIG. 5, each second electrode 343 is formed across the first region Q1 and the second region Q2.

As illustrated as an example in FIG. 5, the first conductive layer 344 and the second conductive layer 345 spaced apart from each other in the X direction are formed on a surface of the second electrode 343. Each first conductive layer 344 and each second conductive layer 345 are strip-like electrodes extending in the Y direction across the plurality of piezoelectric elements 34. A reference voltage is applied to the first conductive layers 344 and the second conductive layers 345. A voltage amounting to the difference between the reference voltage and the drive signal supplied to the first electrode 341 is applied to the piezoelectric layer 342. The first conductive layer 344 is an example of a "conductive layer", and the reference voltage is an example of a "voltage that drives the piezoelectric element".

Each first conductive layer 344 and each second conductive layer 345 are formed of metal having a resistance lower than that of the second electrodes 343, and function as auxiliary wires that suppress the voltage in the corresponding second electrode 343 from dropping. The first conductive layers 344 and the second conductive layers 345 are conductive patterns having a layered structure in which a conductive film formed of gold (Au) is layered on a surface of a conductive film formed of nichrome (NiCr). Furthermore, the first conductive layers 344 and the second conductive layers 345 also function as weights that suppress deformation of the diaphragm 33. In other words, a portion of the piezoelectric element 34 located between the first conductive layer 344 and the second conductive layer 345 in plan view functions as an active portion that becomes deformed according to the applied voltage.

As illustrated as an example in FIGS. 5 and 6, the diaphragm 33 is configured to include layers including a first layer 331 and a second layer 332. When viewed from the first layer 331, the second layer 332 is located on the side opposite the side on which the pressure chamber substrate 32 is located. The plurality of piezoelectric elements 34 are formed on a surface of the second layer 332. In other words, the second layer 332 is located between the first layer 331 and the plurality of piezoelectric elements 34. The first layer 331 is formed of silicon oxide ($SiO_2$), for example, and the second layer 332 is formed of zirconium oxide ($ZrO_2$: zirconia), for example. Compared with the second layer 332, the first layer 331 is formed thick. Note that the first layer 331 can be formed integrally with the pressure chamber substrate 32.

As illustrated as an example in FIG. 5, an opening 334 that penetrates the second layer 332 in a film thickness direction is formed in the second layer 332. As illustrated as an example in FIG. 4, the opening 334 is formed inside the second region Q2 so as to have a rectangular frame shape that surrounds the first region Q1 in plan view. In other words, the opening 334 is included inside the second region Q2 in plan view. The first layer 331 is exposed inside the opening 334. In other words, a groove having inner wall surfaces of the opening 334 as side walls and a surface F2 of the first layer 331 as a bottom surface is formed inside the second region Q2 so as to have a rectangular frame shape. The opening 334 is formed by selectively removing the second layer 332 using a semiconductor manufacturing technique such as, for example, photolithography and etching.

As understood from the description above, the second layer 332 of the first embodiment is separated into a first portion P1 and a second portion P2 with the opening 334 in between. The first portion P1 is a rectangular-shaped portion that overlaps the plurality of pressure chambers C and the plurality of piezoelectric elements 34 in plan view. The second portion P2 is a rectangular frame-shaped portion that is inside the second region Q2 and that surrounds the first portion P1. The space between the first portion P1 and the second portion P2 corresponds to the opening 334. Accordingly, the surface F2 of the first layer 331 is exposed between the first portion P1 and the second portion P2.

As illustrated as an example in FIG. 4, the plurality of pressure chambers C and the plurality of piezoelectric elements 34 are located inside the first region Q1 in plan view. The plurality of piezoelectric elements 34 are formed in plural lines. Specifically, an arrangement (hereinafter, referred to as a "first element line") of two or more piezoelectric elements 34 corresponding to the first line La and an arrangement (hereinafter, referred to as a "second element line") of two or more piezoelectric elements 34 corresponding to the second line Lb are formed inside the first region Q1 in plan view. The first element line and the second element line spaced apart from each other in the X-axis direction are provided side by side inside the first region Q1.

The opening of the second layer 332 is not formed in the first region Q1. In other words, in the first region Q1, the first layer 331 is not exposed from the second layer 332. For example, as understood from FIG. 4, no opening is formed in the region of the second layer 332 located between the first element line and the second element line in plan view. In other words, the first layer 331 is not exposed from the second layer 332 in the portion between the first element line and the second element line. Furthermore, since the first electrodes 341 that are individual electrodes are formed in the first region Q1, in a region overlapping the first electrodes 341 in plan view, the first layer 331 is not exposed from the second layer 332.

As illustrated as an example in FIG. 5, a barrier layer 37A is formed on the diaphragm 33. The barrier layer 37A is formed on a surface of the second layer 332 of the diaphragm 33. Specifically, as illustrated as an example in FIG. 4, the barrier layer 37A is formed in a rectangular frame shape formed along a periphery of the first region Q1 in plan view. The rectangular frame shape is an example of an "annular shape". The barrier layer 37A of the first embodiment is formed of a membrane continuous with the first conductive layers 344 of the piezoelectric elements 34. In other words, the barrier layer 37A is formed in a process and with a material that are the same as those of the first conductive layers 344.

As illustrated as an example in FIG. 5, the barrier layer 37A is formed on both surfaces of the first portion P1 and the second portion P2 in the second layer 332. Accordingly, the barrier layer 37A is formed not only on the surface of the second layer 332 but also inside the opening 334. In the second region Q2, the portion of the barrier layer 37A located inside the opening 334 is in contact with inner wall surfaces F1 of the opening 334 on the first portion P1 side and the surface F2 of the first layer 331. When focusing on an interface Fx between the first layer 331 and the second layer 332, the barrier layer 37A covers the interface Fx between the first layer 331 and the second layer 332 in the second region Q2. Specifically, the barrier layer 37A is in contact with the interface Fx between the first layer 331 and the second layer 332 at a position 336 where the inner wall surfaces F1 of the opening 334 and the surface F2 of the first layer 331 intersect each other. As described above, since the barrier layer 37A covers the interface Fx between the first layer 331 and the second layer 332 in the second region Q2, there is no barrier layer 37A in the first region Q1 between the first layer 331 and the second layer 332. In other words, the first layer 331 and the second layer 332 contact each other directly in the first region Q1.

Figure 7A:
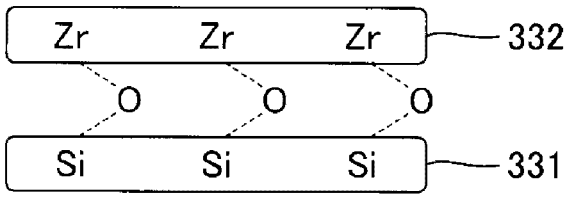
FIG. 7A is a diagram illustrating a state in which a first layer and a second layer of the diaphragm are joined to each other.
Figure 7B:
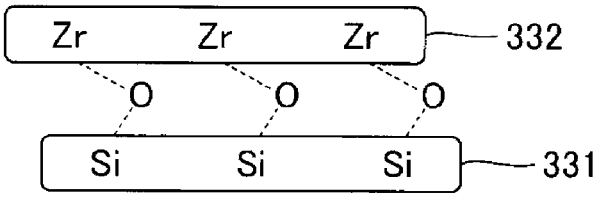
FIG. 7B is a diagram illustrating a state in which stress is generated in the first layer and the second layer of the diaphragm.
Figure 7C:
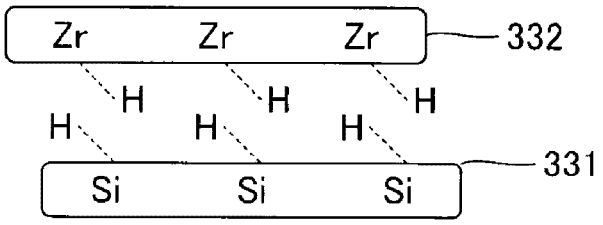
FIG. 7C is a diagram illustrating a state in which hydrolysis has occurred inside the diaphragm.

In a configuration in which the diaphragm 33 is formed of layers including the first layer 331 and the second layer 332, moisture that enters between the first layer 331 and the second layer 332 from an end surface of the diaphragm 33 can become a problem. When moisture enters between the first layer 331 and the second layer 332, there are cases in which a damage such as a crack is caused in the diaphragm 33. FIGS. 7A to 7C are diagrams illustrating a mechanism with which a damage is caused in the diaphragm 33 owing to moisture entering between the first layer 331 and the second layer 332.

As illustrated as an example in FIG. 7A, the first layer 331 and the second layer 332 are joined to each other by having silicon oxide ($SiO_2$) constituting the first layer 331 and the zirconium oxide ($ZrO_2$) constituting the second layer 332 share oxygen (O).

There are cases in which a direct voltage is continuously applied to the piezoelectric elements 34 due to an error or the like of the voltage applied to the piezoelectric elements 34. When the piezoelectric elements 34 are deformed by the continuous application of the direct voltage, as illustrated in FIG. 7B, the diaphragm 33 will also be in a continuously deformed state. Specifically, stress different from each other is generated in the first layer 331 and the second layer 332 and, as a result, continuous stress in which the first layer 331 and the second layer 332 are shifted in the in-plane direction is generated inside the diaphragm 33. With the stress described above, a state in which the activation energy in the interface Fx between the first layer 331 and the second layer 332 is lifted is maintained.

When moisture enters between the first layer 331 and the second layer 332 while, as described above, the activation energy is high, hydrolysis occurs between the first layer 331 and the second layer 332 as illustrated as an example in FIG. 7C. In other words, the oxygen bonded to silicon (Si) in the first layer 331 and the oxygen bonded to zirconia (Zr) in the second layer 332 are substituted by hydrogen (H) in the moisture. Accordingly, the bonding between the first layer 331 and the second layer 332 is cancelled and the first layer 331 and the second layer 332 are separated from each other. As described above, since the first layer 331 is thick compared with the second layer 332, in a state in FIG. 7A in which hydrolysis has not occurred, a virtual plane (hereinafter, referred to as a "stress maximum plane") inside the diaphragm 33 where the stress becomes the largest is located inside the first layer 331. However, in a state in FIG. 7C in which the first layer 331 and the second layer 332 are separated from each other due to the occurrence of hydrolysis, the stress maximum plane is generated inside the second layer 332.

Note that the crystal denseness of the second layer 332 formed of zirconium oxide is lower than that of the first layer 331 formed of silicon oxide. Accordingly, a crystal defect exists in the second layer 332. Stress tends to become concentrated to the crystal defect. Accordingly, in the state in FIG. 7C in which the stress maximum plane is located inside the second layer 332, a local concentration of stress occurs in the second layer 332. A damage is caused in the second layer 332 due to the concentration of stress described above. The mechanism with which a damage is caused in the diaphragm 33 owing to the moisture between the first layer 331 and the second layer 332 is anticipated as above.

As described above, in the first embodiment, the barrier layer 37A covering the interface Fx between the first layer 331 and the second layer 332 is formed; accordingly, the possibility of moisture entering between the first layer 331 and the second layer 332 is reduced. Specifically, even when, for example, moisture enters the second portion P2 between the first layer 331 and the second layer 332 from the end surface of the diaphragm 33, the barrier layer 37A prevents the moisture from reaching the first portion P1 between the first layer 331 and the second layer 332. Accordingly, damage to the diaphragm 33 caused by the moisture between the first layer 331 and the second layer 332 can be suppressed effectively. In the first embodiment, since the barrier layer 37A is formed in an annual shape along the periphery of the first region Q1, the possibility of moisture entering between the first layer 331 and the second layer 332 is reduced across the entire periphery of the diaphragm 33. Accordingly, the above-described effect of suppressing damage from occurring in the diaphragm 33 due to moisture between the first layer 331 and the second layer 332 is particularly notable.

Furthermore, since the barrier layer 37A covers the interface Fx between the first layer 331 and the second layer 332 in the second region Q2, there is no barrier layer 37A in the first region Q1 between the first layer 331 and the second layer 332. In other words, there is no need to form the barrier layer 37A between the first layer 331 and the second layer 332 across the entire surface of the diaphragm 33. Accordingly, compared with a configuration in which the barrier layer 37A between the first layer 331 and the second layer 332 is formed across the entire surface of the diaphragm 33, sufficient displacement of the diaphragm 33 is obtained. As described above, the first embodiment is configured to suppress damage from occurring in the diaphragm 33 and obtain displacement of the diaphragm 33 at the same time. Note that since the displacement of the diaphragm 33 is obtained easily, the voltage applied to the piezoelectric elements 34 needed to displace the diaphragm 33 to the target displacement is reduced. As a result of the decrease in the voltage applied to the piezoelectric elements 34 as described above, an advantage in that time degradation of the piezoelectric elements 34 is suppressed is obtained.

In the first embodiment, since the barrier layer 37A is formed of a material that is the same as that of the first conductive layers 344, the barrier layer 37A and the first conductive layers 344 can be formed in the same process. Accordingly, compared with a configuration in which the barrier layer 37A and the first conductive layers 344 are formed of different materials, there is an advantage in that the manufacturing process of the liquid ejecting head 26 is simplified.

Figure 8:
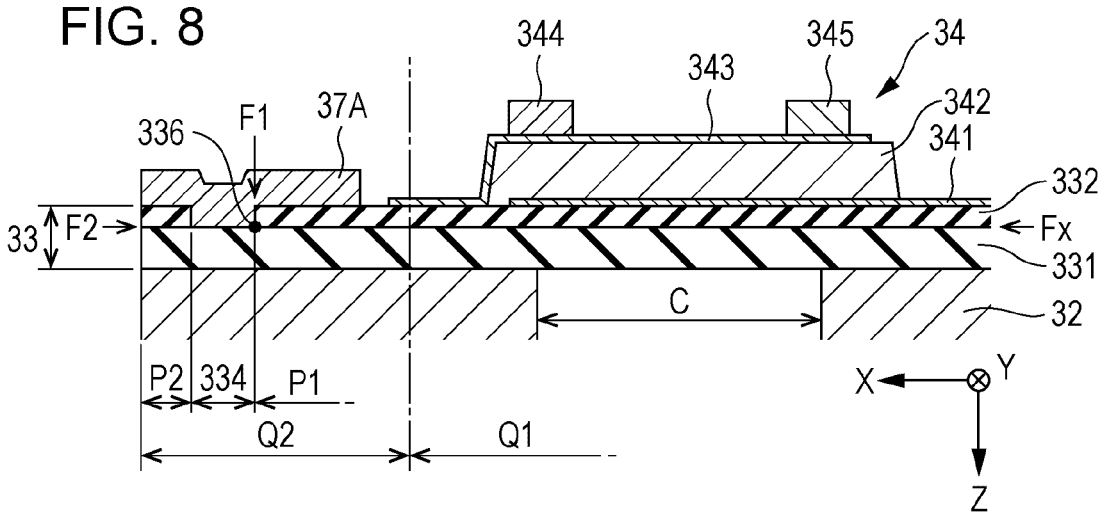
FIG. 8 is a cross-sectional view of a liquid ejecting head according to a modification of the first embodiment.

Note that in the first embodiment, a configuration in which the barrier layer 37A is continuous with the first conductive layers 344 has been illustrated as an example; however, as illustrated as an example in FIG. 8, the barrier layer 37A and the first conductive layers 344 may be separated from each other. Specifically, the first conductive layers 344 are formed on the surface of the second electrodes 343, and the barrier layer 37A is formed in the second region Q2 so as not to overlap the piezoelectric elements 34. In the configuration in FIG. 8 as well, the barrier layer 37A and the first conductive layers 344 are formed of the same material and in the same process.

Second Embodiment

A description of a second embodiment will be given. Note that in the following examples, elements having functions similar to those of the first embodiment will be denoted by applying the reference numerals used in the description of the first embodiment, and detailed description of the elements will be omitted appropriately.

Figure 9:
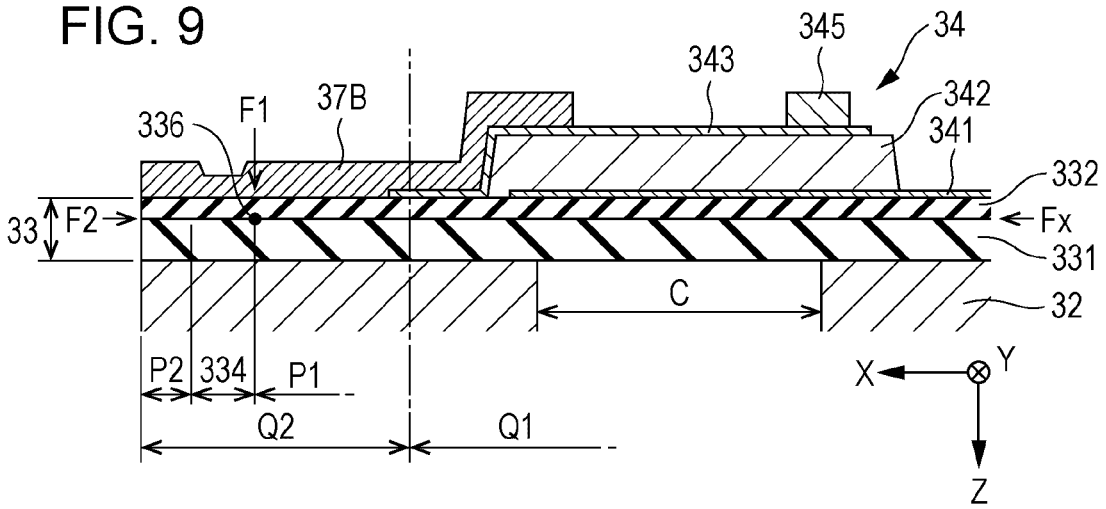
FIG. 9 is a cross-sectional view of a liquid ejecting head according to a second embodiment.

FIG. 9 is a cross-sectional view of the diaphragm 33 and the piezoelectric element 34 according to the second embodiment. FIG. 9 is a cross-sectional view corresponding to FIG. 5 referred to in the first embodiment. As illustrated as an example in FIG. 9, in the second embodiment, the barrier layer 37A of the first embodiment is replaced with a barrier layer 37B.

In the first embodiment, the barrier layer 37A that is continuous with the first conductive layers 344 has been illustrated as an example. The barrier layer 37B of the second embodiment is formed of a material that is different from that of the components of the piezoelectric elements 34. Specifically, the barrier layer 37B is formed of metal oxide that has high adhesion with the first layer 331 and the second layer 332. Furthermore, desirably, the barrier layer 37B is formed of a material with water permeability that is lower than those of the first layer 331 and the second layer 332. A material suitable for the barrier layer 37B includes, for example, aluminum oxide (alumina: $Al_2O_3$), silicon nitride (SiN), hafnium oxide (hafni: $HfO_2$), tantalum oxide ($Ta_2O_5$), or titanium oxide (titania: $TiO_2$).

The mode of the barrier layer 37B is similar to that of the barrier layer 37A of the first embodiment. In other words, the barrier layer 37B is formed on the surface of the second layer 332 of the diaphragm 33 so as to have a rectangular frame shape formed along the periphery of the first region Q1 in plan view. Furthermore, a portion of the barrier layer 37B located in the inner portion of the opening 334 is, in the second region Q2, in contact with the inner wall surfaces F1 on the first portion P1 side and the surface F2 of the first layer 331. In other words, the barrier layer 37B covers the interface Fx between the first layer 331 and the second layer 332 in the second region Q2. Accordingly, an effect similar to that of the first embodiment can be provided in the second embodiment as well. Furthermore, in the second embodiment, since the barrier layer 37B is formed of a material that is different from that of the components of the piezoelectric elements 34, there is an advantage in that the material of the barrier layer 37B can be selected from the viewpoint of reducing the possibility of the moisture entering between the first layer 331 and the second layer 332.

Figure 10:
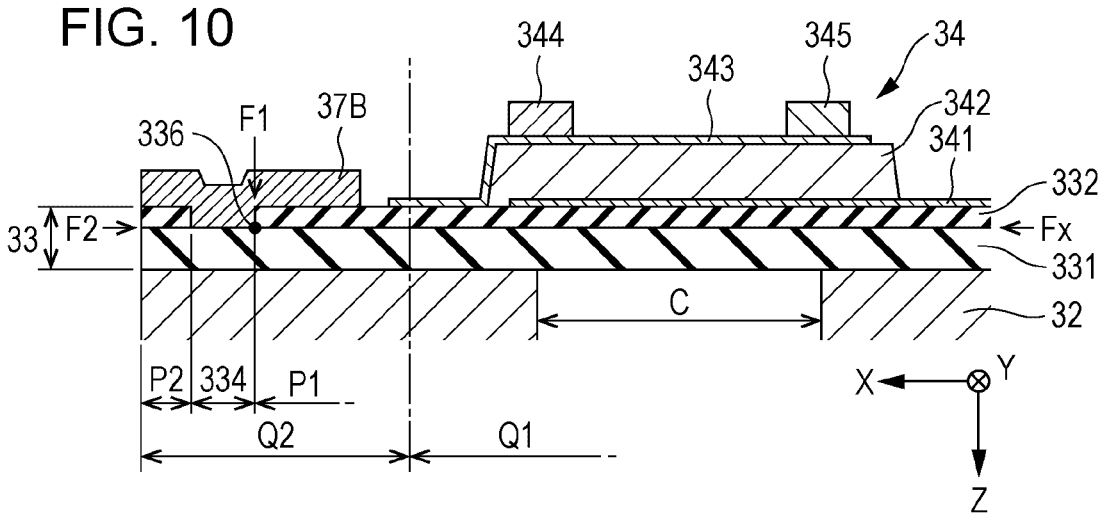
FIG. 10 is a cross-sectional view of a liquid ejecting head according to a modification of the second embodiment.

Note that in FIG. 9, a configuration in which the first conductive layers 344 and the barrier layer 37A of the first embodiment are replaced by the barrier layer 37B has been illustrated as an example; however, as illustrated in FIG. 10, the barrier layer 37B and the first conductive layers 344 may be formed individually in the second embodiment. In the configuration in FIG. 10, the barrier layer 37B is formed in the second region Q2 so as to not overlap the piezoelectric elements 34, and the first conductive layers 344 are formed on the surface of the second electrodes 343 of the piezoelectric elements 34.

Third Embodiment

Figure 11:
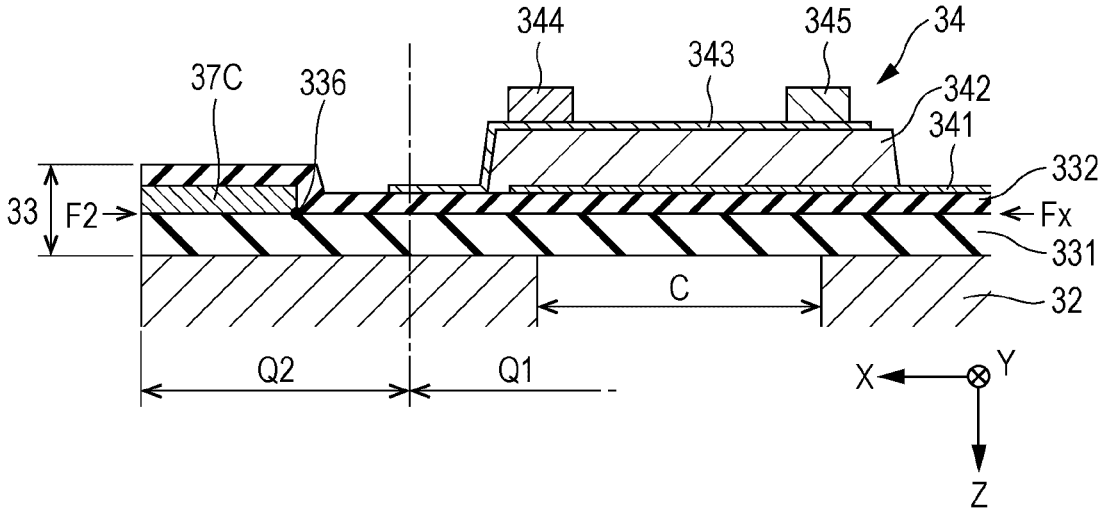
FIG. 11 is a cross-sectional view of a liquid ejecting head according to a third embodiment.

FIG. 11 is a cross-sectional view of the diaphragm 33 and the piezoelectric element 34 according to a third embodiment, and illustrates a cross section corresponding to FIG. 5 referred to in the first embodiment. As illustrated as an example in FIG. 11, a barrier layer 37C is formed in the third embodiment. The barrier layer 37C is located in the second region Q2 of the diaphragm 33 between the first layer 331 and the second layer 332. Specifically, the barrier layer 37C is formed to have a rectangular frame shape in the second region Q2 so as to surround the first region Q1 in plan view. Similar to the second embodiment, metal oxide that has high adhesion with the first layer 331 and the second layer 332 is, desirably, used in forming the barrier layer 37C. A material suitable for the barrier layer 37C is metal oxide including, for example, aluminum oxide, silicon nitride, hafnium oxide, tantalum oxide, or titanium oxide.

As illustrated as an example in FIG. 11, the barrier layer 37C of the third embodiment covers the interface Fx between the first layer 331 and the second layer 332 in the second region Q2. Specifically, in the position 336 on the surface of the first layer 331, the barrier layer 37C is in contact with the interface Fx between the first layer 331 and the second layer 332. As understood from the above description, similar to the first embodiment, the third embodiment reduces the possibility of moisture entering between the first layer 331 and the second layer 332. Accordingly, damage to the diaphragm 33 caused by the moisture between the first layer 331 and the second layer 332 can be suppressed effectively.

Furthermore, since the barrier layer 37C covers the interface Fx between the first layer 331 and the second layer 332 in the second region Q2, the barrier layer 37C between the first layer 331 and the second layer 332 does not need to be formed across the entire surface of the diaphragm 33. Accordingly, compared with a configuration in which the barrier layer 37C is formed across the entire surface of the diaphragm 33, the displacement of the diaphragm 33 is obtained sufficiently.

Furthermore, similar to the second embodiment, in the third embodiment, the barrier layer 37C is formed with a material that is different from that of the components of the piezoelectric elements 34. Accordingly, there is also an advantage in that the material of the barrier layer 37C can be selected from a viewpoint of reducing the possibility of moisture entering between the first layer 331 and the second layer 332.

Fourth Embodiment

Figure 12:
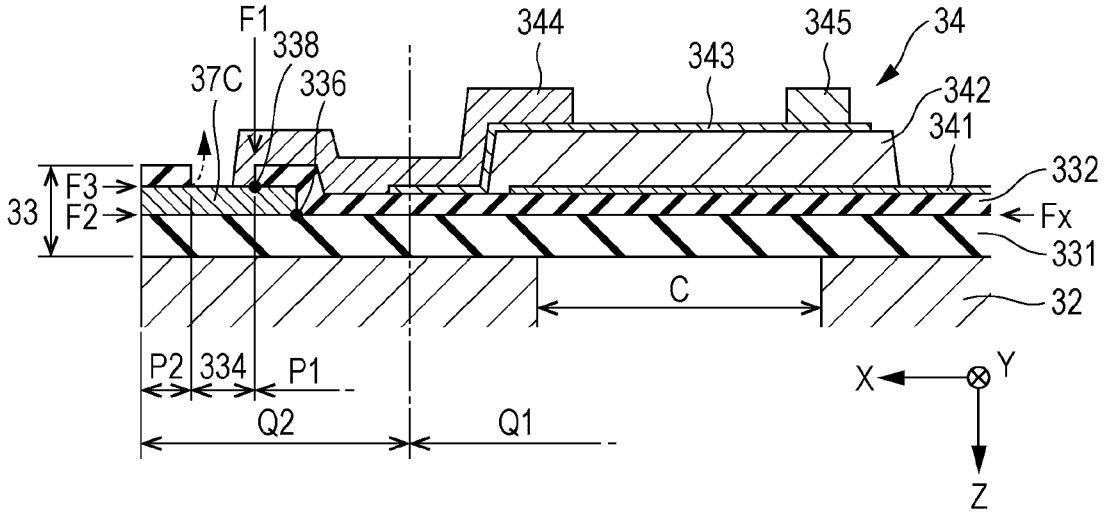
FIG. 12 is a cross-sectional view of a liquid ejecting head according to a fourth embodiment.

FIG. 12 is a cross-sectional view of the diaphragm 33 and the piezoelectric element 34 according to a fourth embodiment, and illustrates a cross section corresponding to FIG. 5 referred to in the first embodiment. As illustrated as an example in FIG. 12, in the fourth embodiment, similar to the third embodiment, the barrier layer 37C located in the second region Q2 of the diaphragm 33 between the first layer 331 and the second layer 332 is formed. As in the description of the third embodiment, the barrier layer 37C covers the interface Fx between the first layer 331 and the second layer 332 in the second region Q2. The material used in forming the barrier layer 37C is similar to that of the third embodiment.

As illustrated as an example in FIG. 12, the opening 334 is formed in the second layer 332 of the fourth embodiment. Similar to the first embodiment, the opening 334 is formed inside the second region Q2 so as to have a rectangular frame shape that surrounds the first region Q1 in plan view. The barrier layer 37C is exposed inside the opening 334. In other words, a groove having inner wall surfaces of the opening 334 as side walls and a surface of the barrier layer 37C as a bottom surface is formed inside the second region Q2 so as to have a rectangular frame shape. As described above in the first embodiment, the above can be described as a configuration in which the second layer 332 is separated into the first portion P1 and the second portion P2 with the opening 334 in between.

As illustrated as an example in FIG. 12, in the fourth embodiment, the first conductive layer 344 of the piezoelectric element 34 is continuously formed from the surface of the second electrode 343 to the surface of the second layer 332. Each first conductive layer 344 reaches the inside of the opening 334 from the surface of the second layer 332. A portion of each first conductive layer 344 that is located inside the opening 334 is in contact with the inner wall surfaces F1 of the opening 334 on the first portion P1 side and a surface F3 of the barrier layer 37C in the second region Q2. In other words, the first conductive layer 344 covers the interface between the barrier layer 37C and the second layer 332 in the second region Q2. Specifically, the first conductive layer 344 is in contact with the interface between the barrier layer 37C and the second layer 332 at a position 338 where the inner wall surface F1 of the opening 334 and the surface F3 of the barrier layer 37C intersect each other.

An effect similar to that of the third embodiment can be provided in the fourth embodiment as well. Furthermore, in the fourth embodiment, the first conductive layer 344 contacts the interface between the barrier layer 37C and the second layer 332 in the second region Q2. Accordingly, there is also an advantage in that the possibility of moisture entering between the barrier layer 37C and the second layer 332 can be reduced. Furthermore, in the fourth embodiment, as illustrated with a broken line arrow in FIG. 12, the moisture that has entered between the barrier layer 37C and the second portion P2 of the second layer 332 from the end surface of the diaphragm 33 is volatilized through the opening 334. Accordingly, the effect of reducing the possibility of moisture entering between the first layer 331 and the second layer 332 is particularly notable.

Fifth Embodiment

Figure 13:
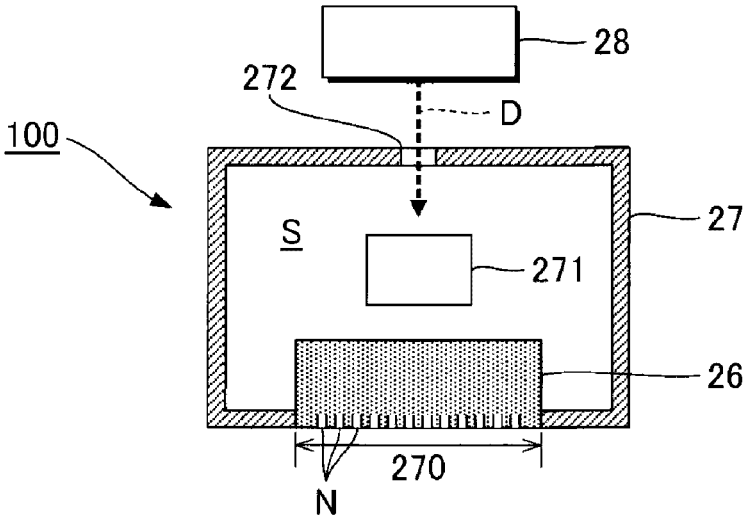
FIG. 13 is a cross-sectional view illustrating, as an example, a partial configuration of a liquid ejecting apparatus according to a fifth embodiment.

FIG. 13 is a cross-sectional view illustrating, as an example, a partial configuration of the liquid ejecting apparatus 100 according to a fifth embodiment. As illustrated as an example in FIG. 13, the liquid ejecting apparatus 100 of the fifth embodiment includes the liquid ejecting head 26, a containing body 27, and an air supply mechanism 28. The configuration of the liquid ejecting head 26 is similar to either of the liquid ejecting heads of the first to fourth embodiments. Accordingly, an effect similar to those of the first to fourth embodiments is obtained in the fifth embodiment.

The containing body 27 is a structure in which a space S containing the liquid ejecting head 26 is formed. The liquid ejecting head 26 is fixed to the containing body 27 so that the plurality of nozzles N are exposed from an opening 270 formed at a bottom portion of the containing body 27.

As illustrated as an example in FIG. 13, a moisture absorbent 271 is provided in the space S. The moisture absorbent 271 is a drying agent that absorbs the moisture in the space S and contains a hygroscopic material such as, for example, silica gel or calcium chloride. Note that for convenience sake, a single moisture absorbent 271 is illustrated as an example in FIG. 13; however, a plurality of moisture absorbents 271 may be provided in the space S.

An air supply port 272 is formed in the containing body 27. The air supply port 272 is a flow path that communicates the space S and the air supply mechanism 28 with each other. The air supply mechanism 28 supplies dry gas D to the space S through the air supply port 272. The dry gas D is a gas in which the water vapor content is 4 g/m$^3$ or less. More preferably, a gas in which the water vapor content is 3 g/m$^3$ or less is used as the dry gas D and, most preferably, a gas in which the water vapor content is 1 g/m$^3$ or less is used as the dry gas D. A typical example of the dry gas D is dry air. The humidity in the space S is reduced by having the dry gas D be supplied thereto with the air supply mechanism 28.

According to the fifth embodiment, since the moisture in the space S is reduced with the moisture absorbent 271 in the space S and by supplying dry gas D from the air supply mechanism 28, the possibility of moisture entering between the first layer 331 and the second layer 332 of the liquid ejecting head 26 is reduced. Accordingly, damage to the diaphragm 33 caused by the moisture between the first layer 331 and the second layer 332 can be suppressed effectively.

Note that in the fifth embodiment, while the liquid ejecting apparatus 100 provided with both the moisture absorbent 271 and the air supply mechanism 28 has been illustrated as an example, either one of the moisture absorbent 271 and the air supply mechanism 28 may be omitted. The air supply port 272 of the containing body 27 is omitted as well in the configuration in which the air supply mechanism 28 is omitted.

Modifications

Each of the embodiments described above as examples can be modified in various ways. Specific modification modes that can be applied to the embodiments described above will be described below as examples. Two or more optionally selected modes from the examples below can be merged as appropriate as long as they do not contradict each other.

Figure 14:
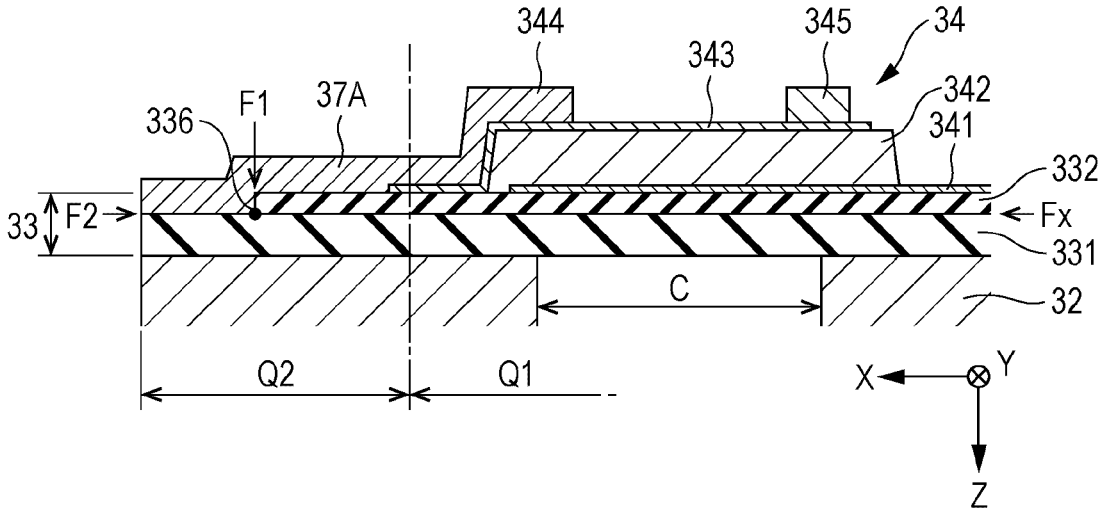
FIG. 14 is a cross-sectional view of a liquid ejecting head according to a modification of the first embodiment.

(1) In the first embodiment, the second layer 332 is separated into the first portion P1 and the second portion P2 with the opening 334 in between; however, as illustrated as an example in FIG. 14, for example, the second portion P2 of the second layer 332 may be omitted. The second portion P2 can be omitted in the second and fourth embodiments in a similar manner. Note that compared with a configuration in FIG. 14 in which the second layer 332 only includes the first portion P1, the configuration in which the second layer 332 includes the first portion P1 and the second portion P2 is advantageous in that the mechanical strength of the diaphragm 33 can be maintained more easily.

(2) In the embodiments described above, a rectangular frame-shaped barrier layer 37 (37A, 37B, and 37C) that surrounds the first region Q1 has been illustrated as an example; however, the planar shape of the barrier layer 37 is not limited to the examples described above. For example, the barrier layer 37 may be formed with a plurality of portions arranged in the second region Q2 so as to surround the first region Q1. Alternatively, the barrier layer 37 may be formed in an area of the periphery of the diaphragm 33 limited to where the moisture enters easily.

Figure 15:
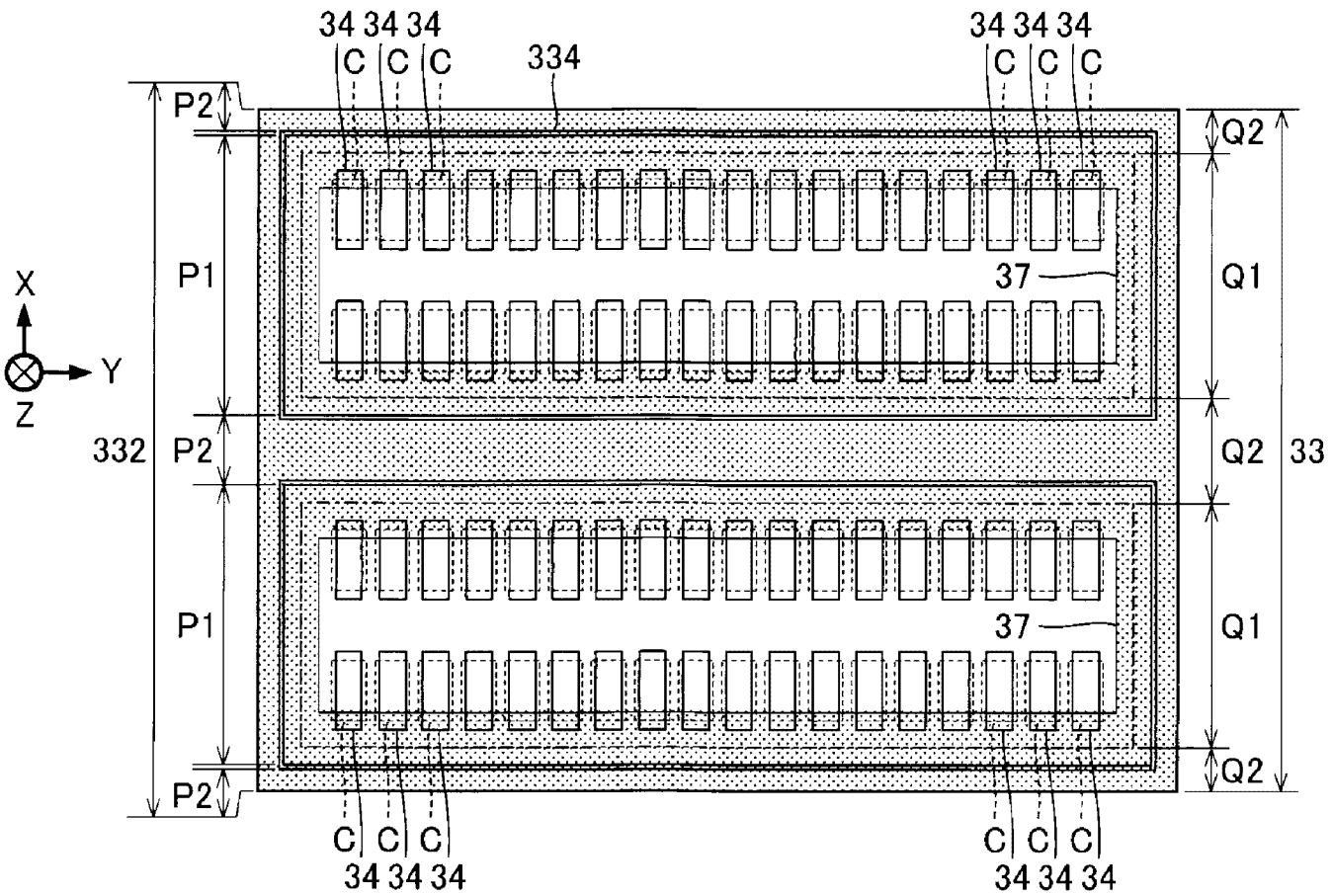
FIG. 15 is a plan view of a diaphragm according to a modification.

(3) In the embodiments described above, a configuration in which the plurality of nozzles N are arranged in two lines, namely, the first line La and the second line Lb, has been illustrated as an example; however, the number of rows of the plurality of nozzles N is not limited to the number illustrated above as an example. Specifically, a configuration in which the plurality of nozzles N are arranged in a single line, or a configuration in which the plurality of nozzles N are arranged in three or more lines are adopted as well. FIG. 15 illustrates, as an example, a configuration in which the plurality of nozzles N are arranged in a total of four lines, namely, first to fourth lines. As illustrated as an example in FIG. 15, the second layer 332 of the diaphragm 33 includes the first portion P1 corresponding to the first line and the second line, and the first portion P1 corresponding to the third line and the fourth line.

(4) While in the embodiments described above, the first electrodes 341 of the piezoelectric elements 34 are individual electrodes and the second electrodes 343 are common electrodes, the first electrodes 341 may be common electrodes and the second electrodes 343 may be individual electrodes. Alternatively, both the first electrodes 341 and the second electrodes 343 may be individual electrodes.

(5) While in the embodiments described above, the serial type liquid ejecting apparatus 100 in which the transport body 242 in which the liquid ejecting head 26 is mounted is reciprocated has been described as an example, a line type liquid ejecting apparatus in which a plurality of nozzles N are distributed across the entire width of the medium 12 can also be applied to the present disclosure.

(6) The liquid ejecting apparatus 100 described as an example in the embodiments described above may be employed in various apparatuses other than an apparatus dedicated to printing, such as a facsimile machine and a copier. Note that the application of the liquid ejecting apparatus of the present disclosure is not limited to printing. For example, a liquid ejecting apparatus that ejects a coloring material solution is used as a manufacturing apparatus that forms a color filter of a display device such as a liquid crystal display panel. Furthermore, a liquid ejecting apparatus that ejects a conductive material solution is used as a manufacturing apparatus that forms wiring and electrodes of a wiring substrate. Furthermore, a liquid ejecting apparatus that ejects a solution of an organic matter related to a living body is used, for example, as a manufacturing apparatus that manufactures a biochip.

What is claimed is:

1. A liquid ejecting head comprising:

a plurality of pressure chambers in communication with nozzles that eject a liquid;

a diaphragm that includes layers including a first layer and a second layer and that constitutes wall surfaces of the plurality of pressure chambers;

a plurality of piezoelectric elements formed on a first region of the diaphragm in plan view of the diaphragm, the piezoelectric elements each being formed to correspond to a corresponding one of the pressure chambers; and a barrier layer that covers an interface between the first layer and the second layer in a second region of the diaphragm, the second region surrounding the first region, wherein the piezoelectric elements include conductive layers to which a voltage that drives the piezoelectric elements is applied, and the barrier layer is formed of a material that is the same as that of the conductive layers.

2. The liquid ejecting head according to claim 1, wherein the barrier layer is formed in an annular shape formed along a periphery of the first region.

3. The liquid ejecting head according to claim 1, wherein an opening that exposes the first layer is formed in the second region of the second layer, and a portion of the barrier layer located inside the opening is in contact with an inner wall surface of the opening and a surface of the first layer.

4. The liquid ejecting head according to claim 3, wherein the second layer includes a first portion that overlaps the plurality of pressure chambers, and a second portion that surrounds the first portion, and the opening is a space between the first portion and the second portion.

5. The liquid ejecting head according to claim 3, wherein the opening is included inside the second region in plan view.

6. The liquid ejecting head according to claim 1, wherein the plurality of pressure chambers are located in the first region in plan view.

7. The liquid ejecting head according to claim 1, wherein the plurality of piezoelectric elements include two or more piezoelectric elements that constitute a first element line, and two of more piezoelectric elements that constitute a second element line provided parallel to the first element line with a space in between.

8. The liquid ejecting head according to claim 7, wherein the first layer is not exposed from the second layer in a portion between the first element line and the second element line.

9. The liquid ejecting head according to claim 1, wherein each of the piezoelectric elements includes layers including a first electrode, a piezoelectric layer, and a second electrode, the first electrode is an individual electrode formed in the first region and for a corresponding one of the piezoelectric elements, and the second electrode is formed in the first region and the second region and is a common electrode continuous across the plurality of piezoelectric elements.

10. The liquid ejecting head according to claim 1, wherein in a region overlapping the individual electrode in plan view, the first layer is not exposed from the second layer.

11. The liquid ejecting head according to claim 1, wherein the barrier layer is formed either of aluminum oxide, silicon nitride, hafnium oxide, tantalum oxide, or titanium oxide.

12. The liquid ejecting head according to claim 1, wherein the barrier layer is located in the second region between the first layer and the second layer.

13. A liquid ejecting apparatus comprising:

the liquid ejecting head according to claim 1.

14. The liquid ejecting apparatus according to claim 13, further comprising:

a containing body in which a space containing the liquid ejecting head is formed; and a moisture absorbent provided in the space.

15. The liquid ejecting apparatus according to claim 14, further comprising:

an air supply mechanism that supplies dry gas into the space.

* * * * *